US009033456B2

(12) United States Patent
Shimoda et al.

(10) Patent No.: US 9,033,456 B2
(45) Date of Patent: May 19, 2015

(54) IMAGE FORMING APPARATUS, LIQUID-JET HEAD, AND METHOD FOR MANUFACTURING THE LIQUID-JET HEAD

(71) Applicants: Tatsuya Shimoda, Kanagawa (JP); Kenichiro Hashimoto, Kanagawa (JP); Keisuke Hayashi, Kanagawa (JP)

(72) Inventors: Tatsuya Shimoda, Kanagawa (JP); Kenichiro Hashimoto, Kanagawa (JP); Keisuke Hayashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/780,345

(22) Filed: Feb. 28, 2013

(65) Prior Publication Data

US 2013/0241990 A1 Sep. 19, 2013

(30) Foreign Application Priority Data

Mar. 19, 2012 (JP) ..... 2012-061674

(51) Int. Cl.

| | |
|---|---|
| ***B41J 2/015*** | (2006.01) |
| ***B41J 2/14*** | (2006.01) |
| ***B41J 2/16*** | (2006.01) |

(52) U.S. Cl.

CPC ..... *B41J 2/14* (2013.01); *B41J 2/14274* (2013.01); *B41J 2/1612* (2013.01); *B41J 2/1623* (2013.01); *B41J 2/1625* (2013.01); *B41J 2/1626* (2013.01); *B41J 2/1631* (2013.01); *B41J 2/1632* (2013.01); *B41J 2002/14403* (2013.01)

(58) Field of Classification Search

CPC ..... B41J 2/045; B41J 2/1625; B41J 2/14233; B41J 2/1607; B41J 2/1614; B41J 2/161

USPC ..... 347/68–72, 20

See application file for complete search history.

(56) References Cited

U.S. PATENT DOCUMENTS

| | | | | |
|---|---|---|---|---|
| 5,424,769 | A * | 6/1995 | Sakai et al. | 347/70 |
| 6,367,914 | B1 | 4/2002 | Ohtaka et al. | |
| 6,682,185 | B2 | 1/2004 | Hashimoto et al. | |
| 6,913,348 | B2 | 7/2005 | Hashimoto et al. | |
| 7,090,325 | B2 | 8/2006 | Hashimoto et al. | |
| 7,364,253 | B2 | 4/2008 | Hashimoto et al. | |
| 7,370,940 | B2 | 5/2008 | Hashimoto | |
| 7,416,281 | B2 | 8/2008 | Nishimura et al. | |
| 7,651,197 | B2 * | 1/2010 | Umeda et al. | 347/54 |
| 7,651,205 | B2 | 1/2010 | Hayashi | |
| 7,665,830 | B2 | 2/2010 | Hashimoto et al. | |
| 7,731,861 | B2 | 6/2010 | Hashimoto et al. | |
| 7,764,006 | B2 | 7/2010 | Tsukamura et al. | |
| 7,871,153 | B2 | 1/2011 | Hayashi | |
| 8,042,918 | B2 | 10/2011 | Hayashi | |
| 8,047,637 | B2 | 11/2011 | Tsukamura et al. | |

(Continued)

FOREIGN PATENT DOCUMENTS

| | | |
|---|---|---|
| JP | 3374899 | 11/2002 |
| JP | 2004090297 A * | 3/2004 |

(Continued)

*Primary Examiner* — Alessandro Amari
*Assistant Examiner* — Michael Konczal
(74) *Attorney, Agent, or Firm* — Cooper & Dunham LLP

(57) ABSTRACT

A liquid-jet head includes a thin film member having a thin part and a thick part, and at least a part of the thin film member is formed of an electroformed film. In the liquid-jet head, the thin film member includes a metallic film forming the thin part, a first electroformed film formed on the metallic film, the first electroformed film forming the thick part, and a second electroformed film covering a connecting part between the metallic film and the first electroformed film.

16 Claims, 18 Drawing Sheets

(56) References Cited

U.S. PATENT DOCUMENTS

| | | | | |
|---|---|---|---|---|
| 8,052,249 | B2 | 11/2011 | Nishimura et al. | |
| 8,118,413 | B2 | 2/2012 | Hashimoto | |
| 8,182,070 | B2 | 5/2012 | Hashimoto | |
| 8,197,048 | B2 | 6/2012 | Yamanaka et al. | |
| 8,303,083 | B2 | 11/2012 | Fujii et al. | |
| 2005/0231561 | A1 | 10/2005 | Hashimoto | |
| 2009/0158910 | A1 * | 6/2009 | Krehel | 83/839 |
| 2011/0298872 | A1 | 12/2011 | Hayashi | |
| 2012/0182356 | A1 | 7/2012 | Hayashi et al. | |

FOREIGN PATENT DOCUMENTS

| | | | |
|---|---|---|---|
| JP | 2010-201718 | | 9/2010 |
| JP | 2010201718 | A * | 9/2010 |
| JP | 2011-183646 | | 9/2011 |
| JP | 2012192709 | A * | 10/2012 |

* cited by examiner

IMAGE FORMING APPARATUS, LIQUID-JET HEAD, AND METHOD FOR MANUFACTURING THE LIQUID-JET HEAD

BACKGROUND OF THE INVENTION

1. Field of the Invention

The disclosures herein relate to a liquid-jet head, an image forming apparatus having the liquid-jet head, and a method for manufacturing the liquid-jet head.

2. Description of the Related Art

An inkjet recording apparatus is generally known as an example of a liquid-jet recording type image forming apparatus, such as a printer, a facsimile machine, or a plotter, or a multifunctional peripheral having combination of these functions. The inkjet recording apparatus includes a recording head formed of a liquid-jet head (liquid-drop jet head) that ejects liquid drops.

There is disclosed, as an example of the liquid-jet head, a piezoelectric head including a deformable diaphragm member forming at least one wall surface of a liquid chamber in communication with nozzles ejecting liquid drops, and a multilayered piezoelectric element configured to pressurize a liquid inside the chamber by the deforming diaphragm member.

Japanese Patent No. 3374899 (hereinafter referred to as "Patent Document 1") discloses an example of such a diaphragm member utilized in the piezoelectric head. In this example, the diaphragm member includes a thick part (i.e., an island-shaped projection part), and a thin part formed in the periphery of the island-shaped projection part. In the diaphragm member, photosensitive resin is formed such that the photosensitive resin covers an outer surface of the island-shaped projection part, and further reaches a part of the thin part, thereby reducing stress concentration applied to a circumference of the island-shaped projection part with concentration due to expansion and contraction of the piezoelectric element.

RELATED ART DOCUMENTS

Patent Document

Patent Document 1: Japanese Patent No. 3374899

As described above, when a diaphragm part of the diaphragm member transmits displacement of the piezoelectric element to an individual liquid chamber, the thin part formed in the circumference of the island-shaped projection part (i.e., the thick part) may need to be repeatedly deformed at the same position. In this configuration, a pin angle formed of a resist trace disposed at a boundary between the thick part and the thin part. Hence, the stress is concentrated on the pin angle when the thin part of the diaphragm member is deformably contracted by deforming the piezoelectric element. This eventually cracks the boundary between the thin part and the thick part to result in leakage of the liquid on the piezoelectric element side.

Thus, a step of coating the outer surface of the diaphragm member with the photosensitive resin in order to reduce the stress applied to the thin part as disclosed in Patent Document 1, which may increase manufacturing cost.

Further, when the thick part is formed by electroforming, the boundary between the thick part and thin part may be undercured upon exposure of light due to an overhang part of the thick part blocking off the exposure light reaching the photosensitive resin.

Accordingly, it is a general object of at least one embodiment of the present invention to provide a liquid-jet head and an image forming apparatus having the liquid-jet head, and a method for manufacturing the liquid-jet head capable of reducing stress concentration applied to a boundary part between a thick part and a thin part of a thin film member at low cost, which substantially eliminate one or more problems caused by the limitations and disadvantages of the related art.

SUMMARY OF THE INVENTION

In one embodiment, there is provided a liquid-jet head that includes a thin film member having a thin part and a thick part, and at least a part of the thin film member is formed of an electroformed film. In the liquid-jet head the thin film member includes a metallic film forming the thin part, a first electroformed film formed on the metallic film, the first electroformed film forming the thick part, and a second electroformed film covering a connecting part between the metallic film and the first electroformed film.

Additional objects and advantages of the embodiments will be set forth in part in the description which follows, and in part will be obvious from the description, or may be learned by practice of the invention.

It is to be understood that both the foregoing general description and the following detailed description are exemplary and explanatory only and are not restrictive of the invention as claimed.

BRIEF DESCRIPTION OF THE DRAWINGS

Other objects and further features of embodiments will be apparent from the following detailed description when read in conjunction with the accompanying drawings, in which.

DESCRIPTION OF THE PREFERRED EMBODIMENTS

Figure 1:
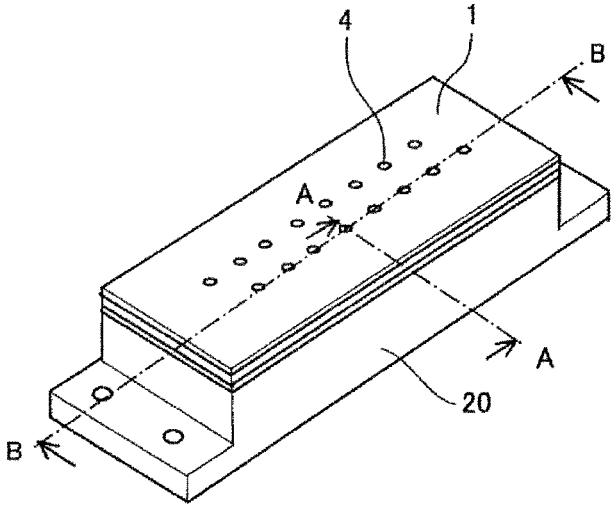
FIG. 1 is an external perspective diagram illustrating a liquid-jet head according to a first embodiment.
Figure 2:
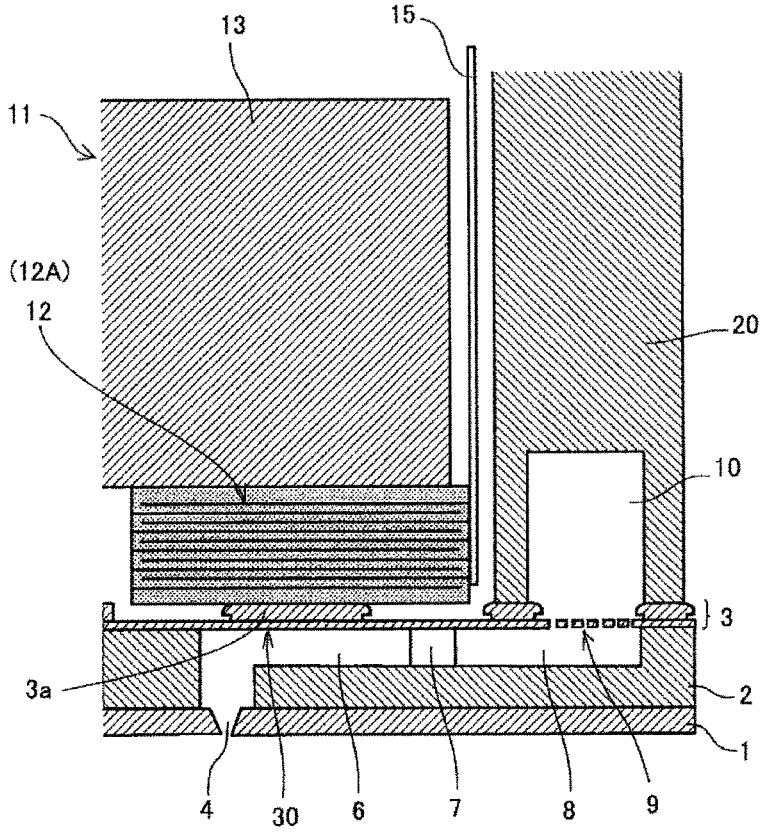
FIG. 2 is a cross-sectional diagram illustrating the liquid-jet head in a direction orthogonal to a nozzle array direction (a liquid chamber longitudinal direction) taken along an A-A line in FIG. 1.
Figure 3:
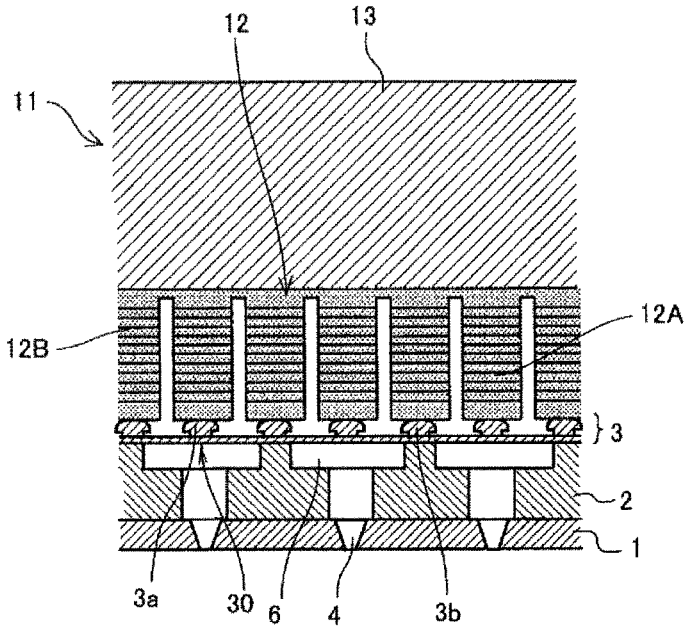
FIG. 3 is a cross-sectional diagram illustrating the liquid-jet head in a direction orthogonal to a nozzle array direction (a liquid chamber short direction) taken along a B-B line in FIG. 1.

Preferred embodiments are described below, with reference to the accompanying drawings. First, a liquid-jet head according to a first embodiment is described with reference to FIGS. 1 to 3. Note that FIG. 1 is an external perspective diagram illustrating a liquid-jet head according to a first embodiment, FIG. 2 is a cross-sectional diagram illustrating the liquid-jet head in a direction orthogonal to a nozzle array direction (a liquid chamber longitudinal direction) taken along an A-A line in FIG. 1, and FIG. 3 is a cross-sectional diagram illustrating the liquid-jet head in a direction orthogonal to a nozzle array direction (a liquid chamber short direction) taken along a B-B line in FIG. 1.

The liquid-jet head according to the first embodiment includes a nozzle plate 1, a channel plate (a liquid chamber substrate) 2, and a diaphragm member 3 serving as a thin-film member that are bonded in a layered manner. The liquid-jet head according to the first embodiment further includes an actuator 11 configured to displace the diaphragm member 3, and a frame member 20 serving as a common channel member constituting a frame of the liquid-jet head.

In the liquid-jet head according to the first embodiment, the nozzle plate 1, the channel plate 2, and the diaphragm member 3 form, as individual channels, individual liquid chambers (may also be called "pressurizing liquid chambers", "pressure chambers", "pressurizing chambers", and "channels") 6 in communication with respective nozzles 4 configured to eject liquid drops, a liquid supply channel 7 configured to supply a liquid to each of the individual liquid chambers 6 and serving as a fluid resistance part, and a liquid introducing part 8 communicating with the liquid supply channel 7.

Accordingly, the liquid-jet head according to the first embodiment supplies a liquid to the plural individual chambers 6 from a common liquid chamber 10 serving as a common channel of the frame member 20 through a filter part 9 formed in the diaphragm member 3, the liquid introducing part 8, and the liquid supply channel 7.

Note that the nozzle plate 1 is formed of a metallic plate made of nickel (Ni), which is produced by electroforming. The nozzle plate 1 is not limited to that formed of the metallic plate made of nickel (Ni), but may be formed of other types of the metallic plate, a resin member, a layered member of a resin layer and a metallic layer, etc. The nozzle plate 1 may include the nozzles 4 having a diameter of 10 to 35 μm corresponding to the respective individual liquid chambers 6, and may be bonded to the channel plate 2 with an adhesive. Further, a water repellent layer is formed on a liquid drop ejecting surface (i.e., a surface in an ejecting direction: an ejecting surface, or a surface opposite to the liquid chamber 6 side) of the nozzle plate 1.

The channel plate 2 includes grooves forming the individual liquid chambers 6, the liquid supply channel 7, and the liquid introducing part 8, which are formed by etching a monocrystalline silicon substrate. Note that the channel plate 2 may be formed by etching a metallic plate such as a SUS substrate with an acid etching liquid, or may be formed by machining such as press working.

The diaphragm member 3 includes a deformable oscillating region 30 corresponding to the individual liquid chamber 6. The deformable oscillating region 30 serves as a wall surface member forming a wall surface of the individual liquid chamber 6 of the channel plate 2.

The piezoelectric actuator 11 is disposed on a side opposite to the individual liquid chambers 6 of the diaphragm member 3, and includes an electromechanical transducer element serving as a driving part (i.e., an actuator part, and a pressure generating part) configured to deform the oscillating region 30 of the diaphragm member 3.

The piezoelectric actuator 11 includes plural layered piezoelectric members 12 bonded on a base members 13 with an adhesive, and desired numbers of column-shaped piezoelectric devices (i.e., piezoelectric columns) 12A and 12B, in which grooves are formed by half-cut dicing, are formed in a pectinate configuration at predetermined intervals corresponding to one of the layered piezoelectric members 12.

The piezoelectric columns 12A and 12B of the piezoelectric member 12 are formed as the same elements. However, the piezoelectric columns 12A and 12B are differentiated as the piezoelectric column 12A serving as a driven pressure column (or a driven column) configured to be driven by being supplied with a driving waveform, and the piezoelectric column 12B serving as a non-driven pressure column (or a non-driven column utilized as a supporting column configured not to be supplied with a driving waveform to be driven.

The driven column 12A is bonded to an island-shaped projection part 3*a* formed in the oscillating region 30 of the diaphragm member 3. Further, the non-driven column (i.e., the piezoelectric column 120) is bonded to a projection part 3*b* of the diaphragm member 3.

The piezoelectric member 12 includes alternate layers of piezoelectric layers and internal electrodes, and external electrodes are formed by drawing the internal electrodes to end faces to which an FPC 15 for supplying driving signals to the external electrodes of the piezoelectric member 12 serving as a flexible printed wiring board is connected.

The frame member 20 may, for example, be made of epoxy resin or thermoplastic resin such as polyphenylene sulfide, which is produced by injection molding. The frame member 20 includes the common liquid chamber 10 to which a liquid is supplied from not-illustrated head tanks or liquid cartridges.

In the inkjet head having the above configuration, the potential applied to the driven column 12A is lowered from a reference potential to cause the driven column 12A to contract, which lowers an oscillating region 30 of the diaphragm member 3 and expands the volume of the individual liquid chamber 6. As a result, the liquid flows into the individual liquid chamber 6 to raise the potential applied to the driven column 12A, which causes the driven column 12A to extend in a stacked direction. This deforms the oscillating region 30 of the diaphragm member 3 toward the nozzle 4 direction to cause the volume of the individual liquid chamber 6 to contract so that the liquid inside the individual liquid chamber 6 is pressurized to thereby eject (jet) liquid drops from the nozzles 4.

When the voltage applied to the driven column 12A returns to the reference potential to restore the oscillating region 30 of the diaphragm 3 to an initial position, the individual liquid chamber 6 expands to generate a negative pressure. As a result, the liquid is supplied into the individual liquid chamber 6 via the liquid supply channel 7 from the common liquid chamber 10. When the oscillations of meniscus in the nozzles 4 are damped and stabilized, the liquid-jet head is moved for a next operation.

Note that a method for driving the liquid-jet head is not limited to the above example, but the liquid-jet head may be driven by applying the driving waveform to the piezoelectric column 12A in different ways so as to cause the piezoelectric column 12A to contract or expand.

Figure 4:
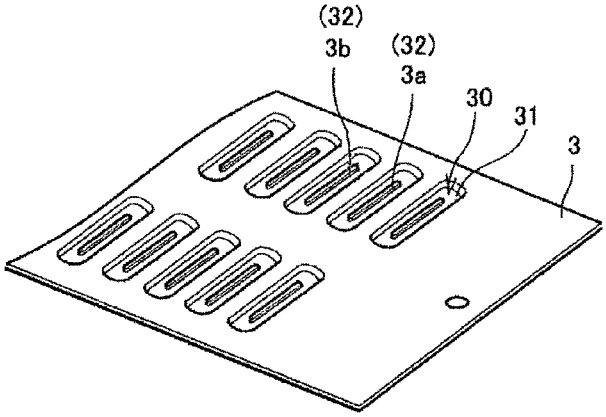
FIG. 4 is a perspective diagram illustrating a diaphragm member serving as a thin member in the liquid-jet head.

Next, details of the diaphragm member 3 serving as in the ink-jet head is described with reference to FIGS. 4 and 5. FIG. 4 is a perspective diagram illustrating a diaphragm member serving as a thin member in the liquid-jet head, and FIG. 5 is a cross-sectional diagram of a main part of the diaphragm member in the liquid-jet head according to the first embodiment.

The oscillating region 30 of the diaphragm member 3 includes a thin part (i.e., a diaphragm part) 31, an island-shaped projection part 3*a* formed by bonding the driven column 12A to the thin part 31. Thus, the island-shaped projection part 3*a* of the oscillating part 30 serves as a thick part 32. Further, a thick part 32 including a projection part 3*b* bonded to a driven column 12B is formed in the periphery of the oscillating region 30 of the diaphragm member 3.

Figure 5:
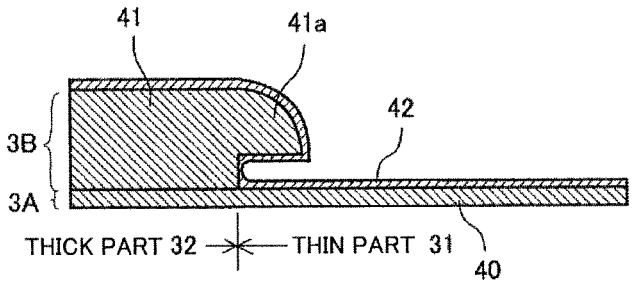
FIG. 5 is a cross-sectional diagram of a main part of the diaphragm member in the liquid-jet head according to the first embodiment.

In this case, a first layer 3A forming the thin part 31 is formed of a metallic film 40 such as an electroformed film as illustrated in FIG. 5. Note that the metallic film 40 may be formed of other metallic films other than the electroformed film.

Further, a second layer 3B forming the thick part 32 together with the first layer 3A is formed of a first electroformed film 41 made, for example, of nickel Ni.

A second electroformed film 42 is formed on surfaces of the metallic film 40 and the first electroformed film 41 such that the second electroformed film 42 is applied to a connecting part between the metallic film 40 forming the first layer 3A and the first electroformed film 41 forming the second layer 3B.

With this configuration, the second electroformed film 42 may be able to serve a function to disperse the stress applied to the boundary between the metallic film 40 and the first electroformed film 41. That is, the second electroformed film 42 may be able to serve a function to disperse the stress applied to the boundary between the thin part 31 and the thick part 32, thereby relaxing the concentrated stress applied to the boundary.

Figure 6:
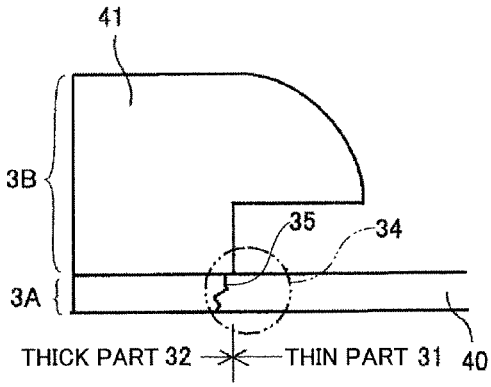
FIG. 6 is a cross-sectional diagram of a main part of a diaphragm member according to a comparative example.

Note that this aspect is further described with reference to FIGS. 6 and 7A to 70. FIG. 6 is a cross-sectional diagram of a main part of a diaphragm member according to a comparative example, and FIGS. 7A to 7C are diagrams illustrating a deformation operation of a diaphragm member region with driving of a piezoelectric element.

The comparative example illustrated in FIG. 6 includes a configuration not having the second electroformed film 42 of the first embodiment. In the comparative example, a first layer 3A is formed of an electroformed film, and a second layer 3B formed of the same material of a first electroformed film is layered on the first layer 3A. In the configuration of the comparative example, a pin angle (i.e., 90 degrees corner) 34 is formed at the boundary between the thin part 31 and the thick part 32.

Figure 7A:
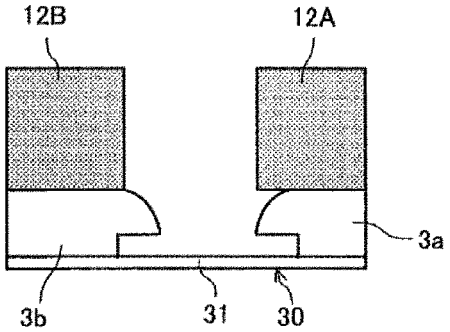
FIGS. 7A to 7C are diagrams illustrating a deformation operation of a diaphragm member region with driving of a piezoelectric element.
Figure 7B:
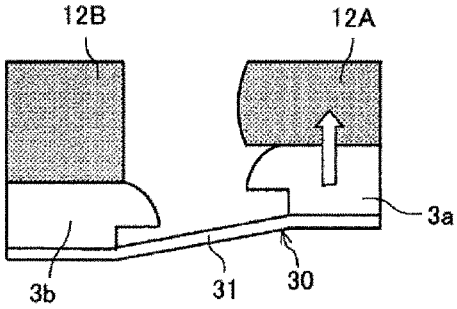
Figure 7C:
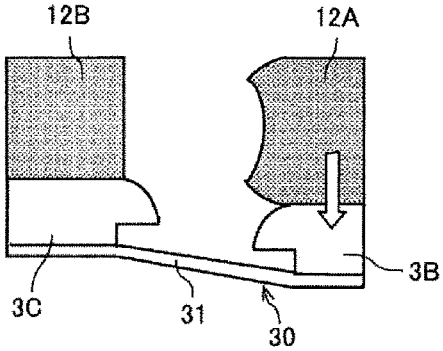

Meanwhile, as described earlier, the driven column 12A is contracted and then expanded for driving the liquid-jet head; that is, the driven column 12A is deformed from an initial state illustrated in FIG. 7A to a contracted state illustrated in FIG. 7B, and then expanded in a state illustrated in FIG. 7C. At this moment, the oscillating region 30 is folded at the boundary between the thin part 31 and the thick part 32 (i.e., the projection parts 3*a* and 3*b*).

Accordingly, if the pin angle 34 is formed at the boundary between the thin part 31 and the thick part 32 as illustrated in the configuration of the comparative example, the stress is concentrated on the pin angle 34 by repeated displacement of the oscillating region 30, thereby causing the damage to the diaphragm member region due to cracking 35 in the boundary as illustrated in FIG. 6.

By contrast, in the liquid-jet head according to the first embodiment, the boundary between the thin part 31 and the thick part 32 form an R-shaped angle (an R-shaped corner), thereby preventing the boundary between the thin part 31 and the thick part 32 being damaged due to cracking.

In addition, in the liquid-jet head according to the first embodiment, since the second layer 3B forming the island-shaped projection part 3*a* is formed of the first electroformed film 41, a so-called "overhang shape" (i.e., the overhang part 41*a*) is formed as illustrated in FIG. 5.

Thus, even if the boundary (i.e., the connecting part) between the thin part 31 and the thick part 32 is coated with the aforementioned photosensitive resin, the exposure light underreaches the connecting part (the boundary part), thereby allowing the connecting part to remain uncured. However, when the second layer 3B forming the island-shaped projection part 3*a* is formed of the first electroformed film 41, the connecting part may be securely coated with the photosensitive resin.

Next, a method for manufacturing the liquid-jet head according to the first embodiment is described with reference to FIGS. 8A to 8D. FIGS. 8A to 8D are cross-sectional diagrams illustrating the method for manufacturing the liquid-jet head according to the first embodiment.

Figure 8A:
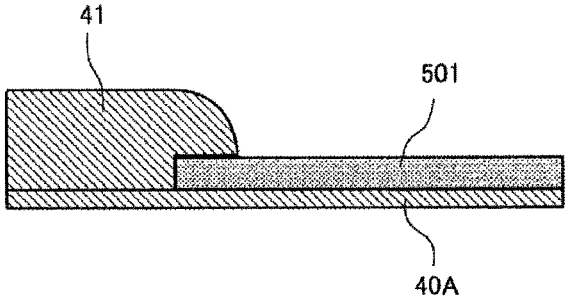
FIGS. 8A to 8D are cross-sectional diagrams illustrating a method for manufacturing the liquid-jet head according to the first embodiment.
Figure 8B:
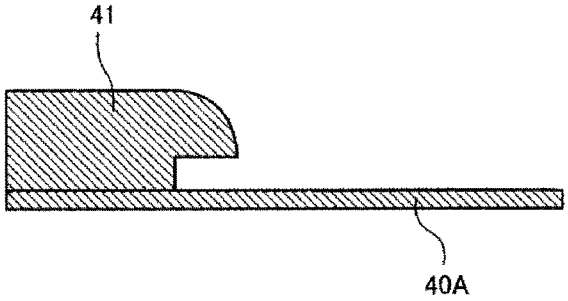

As illustrated in FIG. 8A, an electroformed film 40A serving as the metallic film 40 is formed on a not-illustrated electroformed support substrate by electroforming, a resist pattern 501 having an opening corresponding to a region in which projection parts 3*a* and 3*b* are formed is formed on the electroformed film 40A, and electroforming is then carried out, thereby forming a first electroformed film 41.

Subsequently, the resist pattern 501 is removed as illustrated in FIG. 8G.

Figure 8C:
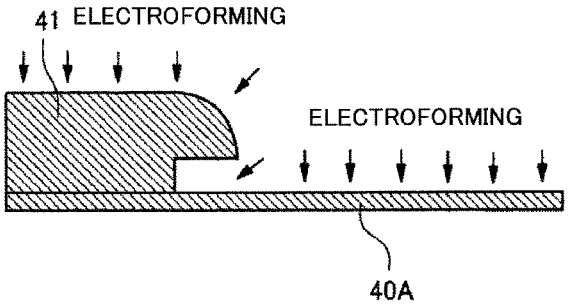
Figure 8D:
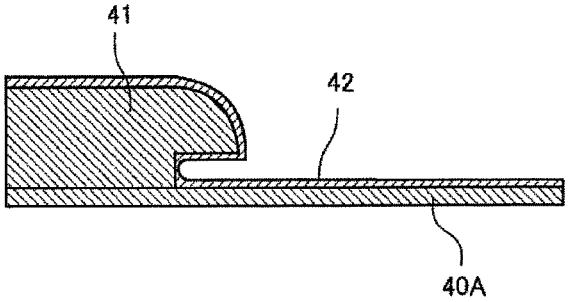

Then, a second electroformed film is formed over the first electroformed film 41 and the electroformed film 40A as illustrated in FIG. 8D by electroforming as illustrated in FIG. 8C.

At this moment, two surfaces (vertical and horizontal surfaces) of a pin angle (i.e., a pin corner) formed at a boundary between the electroformed film 40A and the first electroformed film 41 is encircled by an electroformed material (e.g., Ni). Accordingly, a current is further concentrated to electroform Ni, thereby causing Ni to be concentrated in the pin angle part. As a result, the pin angle is formed in an "R shape".

As a result, the above-described diaphragm member in the first embodiment may be obtained.

Figure 9:
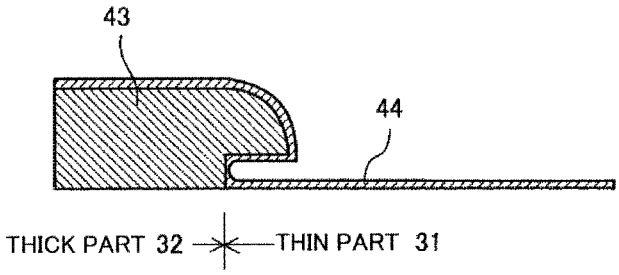
FIG. 9 is a cross-sectional diagram illustrating a main part of a diaphragm member in a liquid-jet head according to a second embodiment.

Next, a liquid-jet head according to a second embodiment is described with reference to FIG. 9. FIG. 9 is a cross-sectional diagram illustrating a main part of a diaphragm member in a liquid-jet head according to a second embodiment.

In the liquid-jet head according to the second embodiment, a diaphragm member 3 is formed of a third electroformed film 43 forming the thick part 32 (e.g., the projection parts 3*a* and 3*b*), and a fourth electroformed film 44 forming a thin part 31 and covering a surface of the third electroformed film 43.

In this configuration, the pin angle not formed at the boundary between the thick part 32 and the thin part 31, but an "R shape" is formed at the boundary between the thick part 32 and the thin part 31 instead, thereby reducing the stress concentration.

Next, a method for manufacturing the liquid-jet head according to the second embodiment is described with reference to FIGS. 10A to 10D. FIGS. 10A to 10D are cross-sectional diagrams illustrating a method for manufacturing the liquid-jet head according to the second embodiment.

Figure 10A:
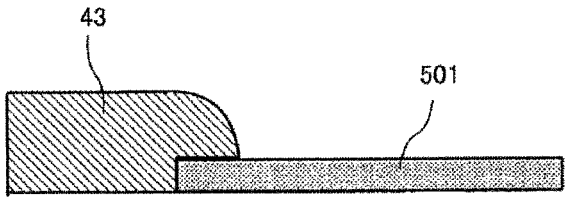
FIGS. 10A to 10D are cross-sectional diagrams illustrating a method for manufacturing the liquid-jet head according to the second embodiment.

As illustrated in FIG. 10A, a resist pattern 501 having an opening corresponding to a region in which projection parts 3*a* and 3*b* are formed is formed on a not-illustrated electroformed support substrate, and electroforming is then carried out, thereby forming a third electroformed film 43.

Figure 10B:
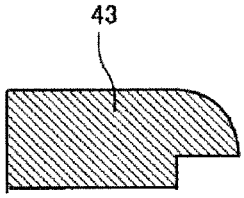

Subsequently, the resist pattern 501 is removed as illustrated in FIG. 10B.

Figure 10C:
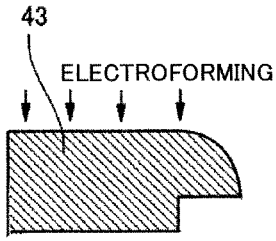

Then, a fourth electroformed film 44 serving as a thin part 31 and covering a surface of the third electroformed film 43 is formed as illustrated in FIG. 8D by electroforming as illustrated in FIG. 10C.

As a result, the above-described diaphragm member in the second embodiment may be obtained.

Next, a Liquid-jet head and a method for manufacturing the liquid-jet head according to a third embodiment described with reference to FIGS. 11A to 11D. FIGS. 11A to 11D are cross-sectional diagrams illustrating the liquid-jet head and the method for manufacturing the liquid-jet head according to the third embodiment.

Figure 11A:
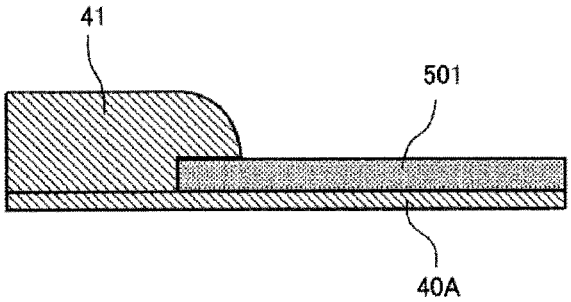
FIGS. 11A to 11D are cross-sectional diagrams illustrating a liquid-jet head and a method for manufacturing the liquid-jet head according to the third embodiment.

As illustrated in FIG. 11A, an electroformed film 40A is formed on a not-illustrated electroformed support substrate by electroforming, a resist pattern 501 having an opening corresponding to a region in which projection parts 3*a* and 3*b* are formed is formed on the electroformed film 40A, and electroforming is then carried out, thereby forming a first electroformed film 41.

Figure 11B:
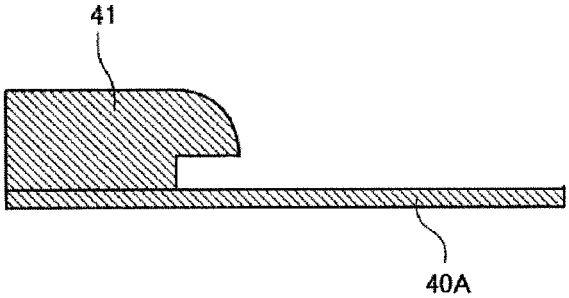

Next, the resist pattern 501 is removed as illustrated in FIG. 11B.

Figure 11C:
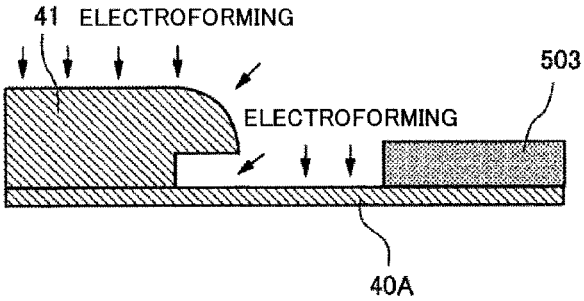
Figure 11D:
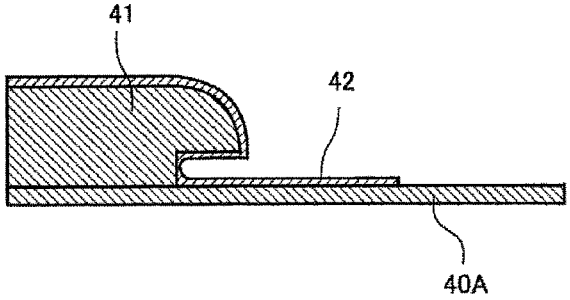

Then, as illustrated in FIG. 11C, a resist pattern 503 is formed in a region on the electroformed film 40A where the second electroformed film 42 is not formed, the second electroformed film 42 is formed by electroforming, and the resist pattern 503 is then removed as illustrated in FIG. 11D.

Thus, in the liquid-jet head according to the second embodiment, the second electroformed film 42 is not formed in a region of a surface of the electroformed film 40A other than a region necessary for applying the photosensitive resin to the connecting part between the thin part 31 and the thick part 32.

Since the thickness of the thin part 31 of the diaphragm member 3 largely affects the amount of displacement of the oscillating region 30, it is preferable to minimize the thickness of the thin part 31 and uniformly form the thickness of the thin part 31. In the liquid-jet head according to the third embodiment, since the diaphragm member is formed without having the second electroformed film 42 formed in the unnecessary region, and the thickness of the thin part 31 is formed with the thickness accuracy of the electroformed film 40A, the thickness of the thin part 31 may be uniformly formed.

Figure 12:
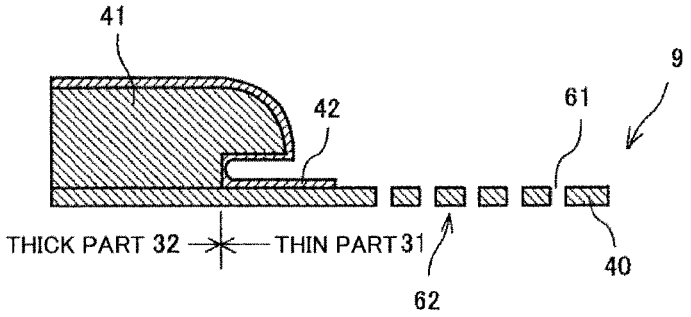
FIG. 12 is a cross-sectional diagram illustrating a filter part in a liquid-jet head according to a fourth embodiment.

Next, a liquid-jet head according to a fourth embodiment is described with reference to FIG. 12. FIG. 12 is a cross-sectional diagram illustrating a filter part in the liquid-jet head according to the fourth embodiment.

The liquid-jet head according to the fourth embodiment is provided with a filter member for eliminating extraneous particles. In the liquid-jet head according to the first embodiment, a filter part 9 having numerous small-sized pores is formed in the diaphragm member 3 between the common liquid chamber 10 and the liquid introducing part 8 as described above.

The filter part 9 serves as a part of the diaphragm member 3. Accordingly, the filter part 9 includes numerous filter pores 61 that are formed in the metallic film 40 serving as the thin part 31, a first electroformed film 41 serving as a projection par connected to a frame member 20 and forming the thick part 32 that is layered on the metallic film 40, and a second electroformed film 42 covering the surfaces of the first electroformed film 41 and the metallic film 40, in a manner similar to that of the first embodiment.

Accordingly, a second electroformed film 42 covers a connecting part between the metallic film 40 serving as the thin part 31 forming a filter region 62 and the first electroformed film 41 forming the thick part 32 to obtain the filter part (i.e., the filter member) 9 having the reduced stress concentration.

Note that in the liquid-jet head according to the fourth embodiment, the filter member is formed of a part of the diaphragm member; however, the filter member may be materials other than the diaphragm member.

Next, a method for the liquid-jet head according to the fourth embodiment is described with reference to FIGS. 13A to 13E. FIGS. 13A to 13E are cross-sectional diagrams illustrating the method for manufacturing the liquid-jet head according to the fourth embodiment.

Figure 13A:
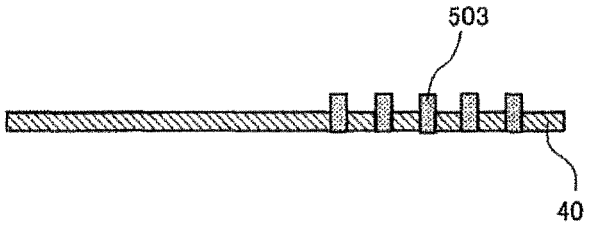
FIGS. 13A to 13E are cross-sectional diagrams illustrating a method for manufacturing the liquid-jet head according to the fourth embodiment.
Figure 13B:
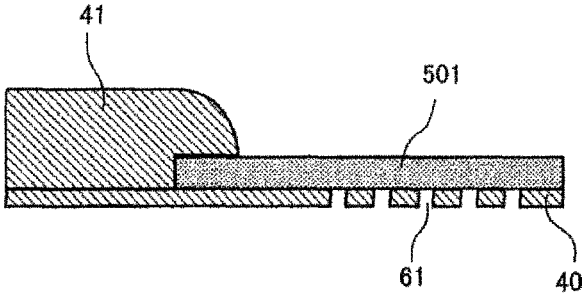

As illustrated in FIG. 13A, a resist pattern 503 is formed on parts of a not-illustrated electroformed film 40A corresponding to the filter pores, and then electroforming is carried cut, thereby forming an electroformed film 40A having the filter pores 61 as illustrated in FIG. 13B.

Then, as illustrated in FIG. 10B, a resist pattern 501 having an opening corresponding to a thick part to be formed on the electroformed film 40A is formed, and electroforming is then carried out, thereby forming a first electroformed film 41 serving as the thick part (i.e., the projection part).

Figure 13C:
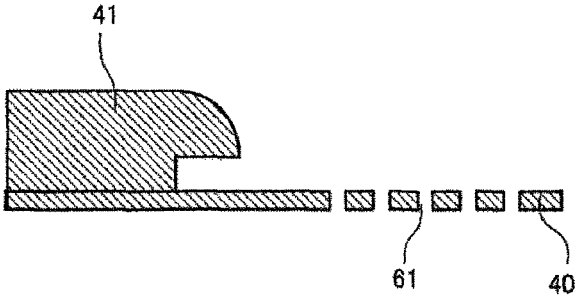

Subsequently, the resist pattern 501 formed on the electroformed film 40A is removed as illustrated in FIG. 13C.

Figure 13D:
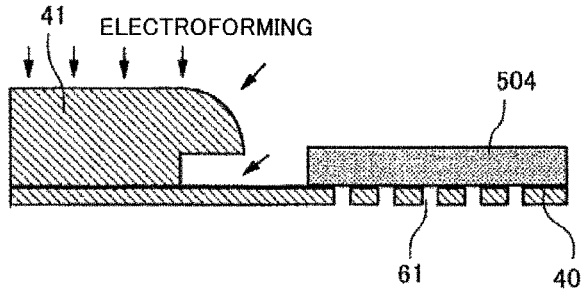

Thereafter, a resist pattern 504 is formed again in a filter region on the electroformed film 40A (i.e., a region where the filter pores 61 are formed), and then electroforming is carried out as illustrated in FIG. 13D.

Figure 13E:
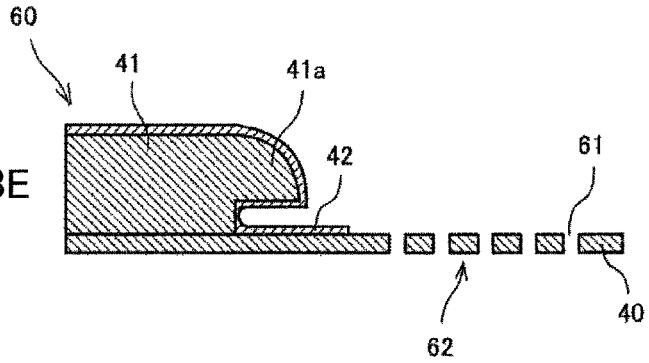

As a result, as illustrated in FIG. 13E, a second electroformed film 42 is formed such that the second electroformed film 42 covers an entire region including the electroformed film 40A and the first electroformed film 41, and the resist pattern 504 is then removed.

The filter member in the liquid-jet head according to the fourth embodiment is thus obtained.

Figure 14:
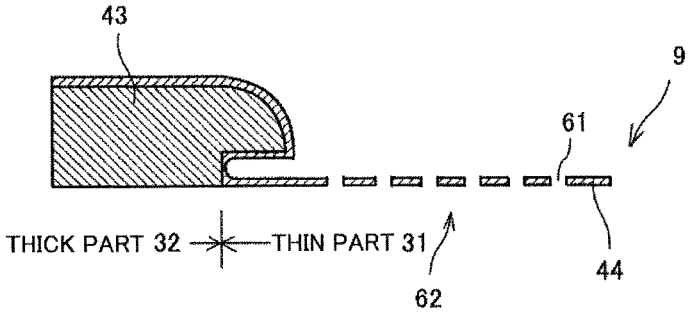
FIG. 14 is a cross-sectional diagram illustrating a filter part in a liquid-jet head according to a fifth embodiment.

Next, a liquid-jet head according to a fifth embodiment is described with reference to FIG. 14. FIG. 14 is a cross-sectional diagram illustrating a filter part in the liquid-jet head according to the fifth embodiment.

Since the filter part 9 is a part of the diaphragm member 3, the filter part 9 is formed of a third electroformed film 43 forming the thick part 32 (e.g., the projection part connected to the frame member 20), and a fourth electroformed film 44 serving as the thin part 31 that is configured to cover the surface of the third electroformed film 43 and have numerous filter pores 61, similar to the second embodiment.

Thus, a connecting part between the fourth electroformed 44 serving as the thin part and forming the filter region 62 and the third electroformed film forming the thick part 32 forms an R shape, thereby obtaining the filter part (i.e., the filter member) 9 having the reduced stress concentration.

Note that in the liquid-jet head according to the fifth embodiment, the filter member is formed of a part of the diaphragm member; however, the filter member may be materials other than the diaphragm member.

Next, a method for the liquid-jet head according to the fifth embodiment is described with reference to FIGS. 15A to 15D. FIGS. 15A to 15D are cross-sectional diagrams illustrating the method for manufacturing the liquid-jet head according to the fifth embodiment.

Figure 15A:
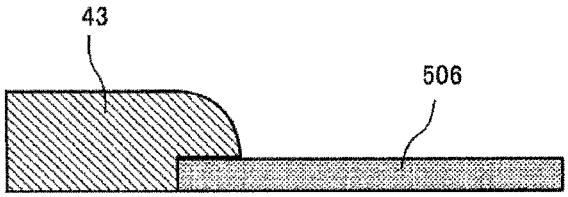
FIGS. 15A to 15D are cross-sectional diagrams illustrating a method for manufacturing the liquid-jet head according to a fifth embodiment.

In this embodiment, as illustrated in FIG. 15A, a resist pattern 506 having an opening corresponding to a region in which projection parts are formed is formed on a not-illustrated electroformed support substrate, and electroforming is then carried out, thereby forming a third electroformed film 43.

Figure 15B:
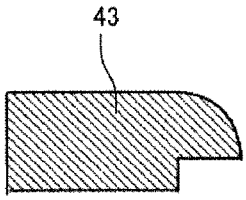

Subsequently, the resist pattern 506 is removed as illustrated in FIG. 15B.

Figure 15C:
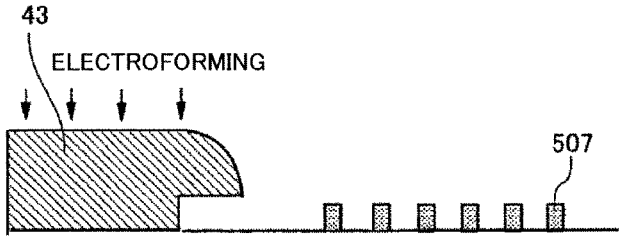

Thereafter, as illustrated in FIG. 15C, a resist pattern 507 is formed on a not-illustrated electroformed support substrate corresponding to a region in which filter pores 61 are formed, and electroforming is then carried out as illustrated in FIG. 15C.

Figure 15D:
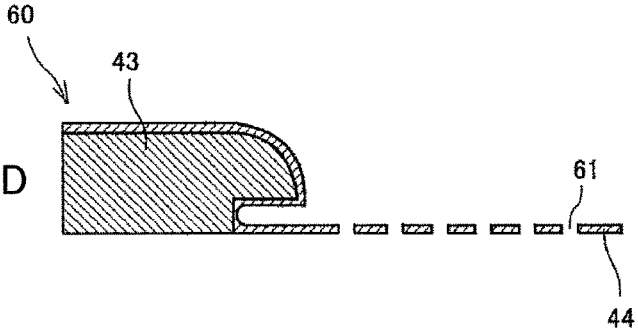

As a result, the fourth electroformed film 94 having the filter pores 61 is formed, and the resist pattern 507 is then remove as illustrated in FIG. 15D.

The filter member in the liquid-jet head according to the fifth embodiment is thus obtained.

Next, a liquid-jet head and a method for manufacturing the liquid-jet head according to a sixth embodiment is described with reference to FIGS. 16A to 16D. FIGS. 16A to 16D are cross-sectional diagrams illustrating the liquid-jet head and the method for manufacturing the liquid-jet head according to the sixth embodiment.

In the liquid-jet head according to the sixth embodiment, a material having a relatively high Young's modulus such as nickel (Ni) is used for the thick part, and a material having a relatively low Young's modulus such as copper (Cu) is used for the thin part in the second embodiment. Note that the above materials may be utilized the embodiments other than the second embodiment.

Thus, utilizing different materials for the thick part and the thin part may provide effects of increasing rigidity of a non-moving part owing to the use of the material having a high Young's modulus, and facilitating displacement of a moving part owing to the use of the material having a low Young's modulus. Accordingly, the thin film member having a higher displacement effect may be obtained.

Figure 16A:
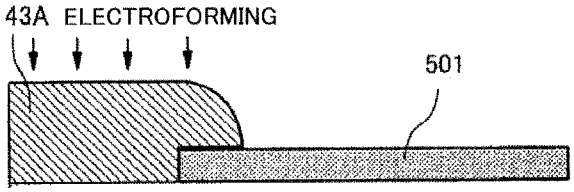
FIGS. 16A to 16D are cross-sectional diagrams illustrating a liquid-jet head and a method for manufacturing the liquid-jet head according to the sixth embodiment.

In the method for manufacturing the liquid-jet head according to the sixth embodiment, a resist pattern 501 having an opening is formed in a region in which the thick part including the projection parts are formed on a not-illustrated electroformed support substrate, and electroforming is carried out with a first material (e.g., nickel), thereby forming a third electroformed film 43A as illustrated in FIG. 16A.

Figure 16B:
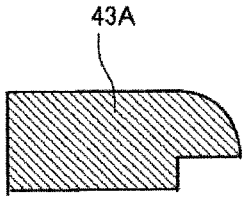

Subsequently, the resist pattern 501 is removed as illustrated in FIG. 16B.

Figure 10D:
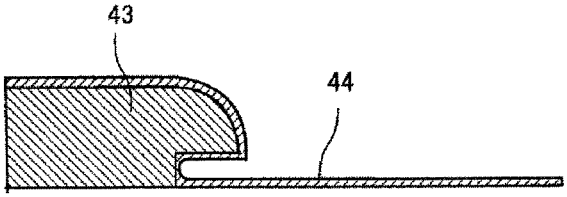
Figure 16C:
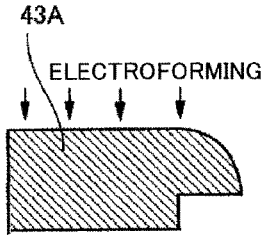
Figure 16D:
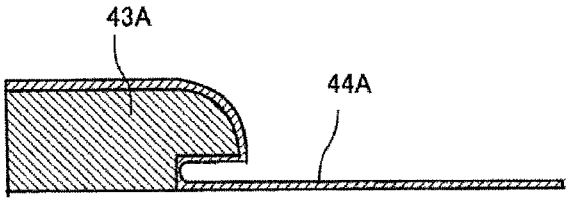

Then, a fourth electroformed film 44A serving as a thin part and covering a surface of the third electroformed film 43A is formed as illustrated in FIG. 10D by electroforming with a second material (e.g., copper Cu) as illustrated in FIG. 16C.

Figure 17:
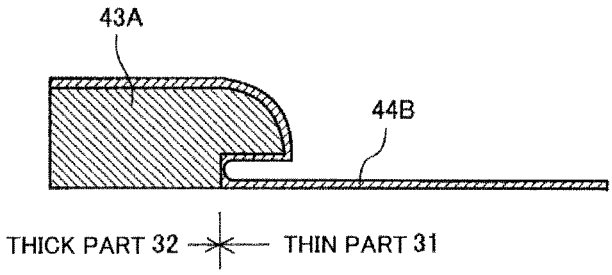
FIG. 17 is a cross-sectional diagram illustrating a liquid-jet head according to a seventh embodiment.

Next, a liquid-jet head according to an eighth embodiment is described with reference to FIG. 17. FIG. 17 is a cross-sectional diagram illustrating an oscillating region of a liquid-jet head according to a seventh embodiment.

In the liquid-jet head according to the eighth embodiment, a third electroformed film 43A and a fourth electroformed film 44B are formed such that the third electroformed film 43A has a mean particle size greater than that of the fourth electroformed film 44B in the second embodiment. Mote that the configuration in which the third electroformed film has a mean particle size greater than that of the fourth electroformed film may be utilized the embodiments other than the second embodiment.

For example, initially, low electric current density is set to a part of the diaphragm member 3 allowing to in have a greater mean particle size other than the thin part. Accordingly, a deposition rate atoms may be lower than a crystal growth rate, and as a result, the part having a greater mean particle size (i.e., the third electroformed film 43A) is formed.

Subsequently, high electric current density is set to the thin part of the diaphragm member 3 allowing to have a less mean particle size. Accordingly, a deposition rate atoms may be higher than a crystal growth rate, and as a result, the part having a reduced mean particle size (i.e., the fourth electroformed film 44B) is formed.

When the fourth electroformed film 44B having a reduced mean particle size is formed, an anchor effect is exhibited on the third electroformed film 43A having a greater mean particle size, and the fourth electroformed film 44B serving as the thin part includes a reduced number of nests or pinholes, and hence, the fourth electroformed film 44B having a plane with a reduced number of projections or recesses may be obtained.

Figure 18:
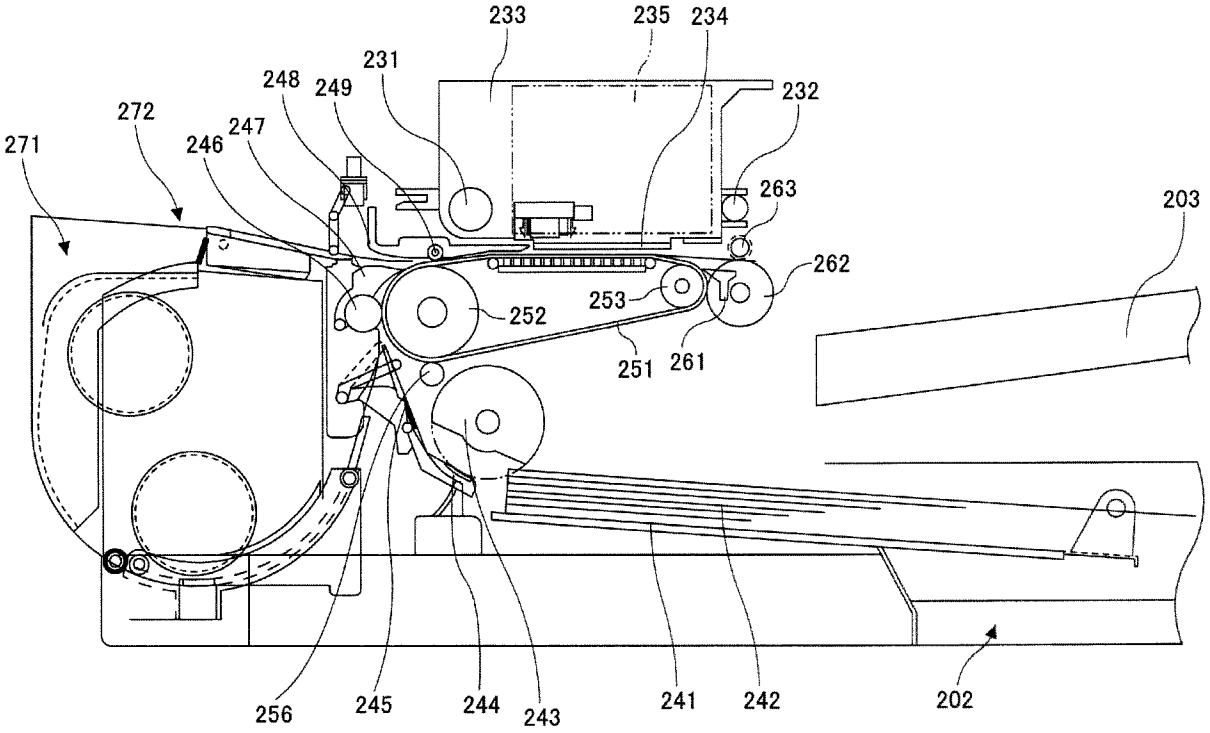
FIG. 18 is a side diagram illustrating an example of a mechanical part of an image forming apparatus having the liquid-jet head according to the embodiments.
Figure 19:
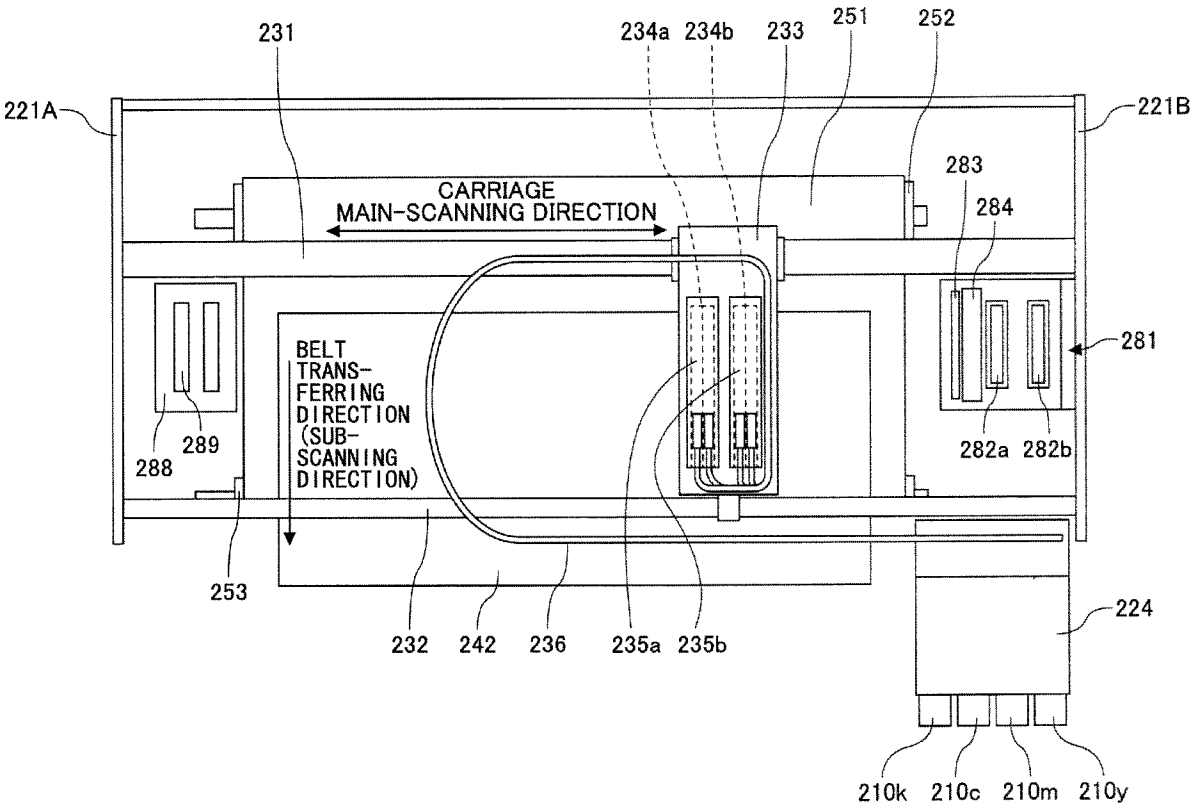
FIG. 19 is a plan diagram illustrating a main part of the mechanical part.

Next, an example of an image forming apparatus having the liquid-jet head according to an embodiment is described with reference to FIGS. 18 and 19. Note that FIG. 18 is a side diagram illustrating an example of a mechanical part of an image forming apparatus having the liquid-jet head according to the embodiments, and FIG. 19 is a plan diagram illustrating a main part of the mechanical part.

The image forming apparatus is a serial-type image forming apparatus. The serial-type image forming apparatus includes a carriage 233 that is slidably supported in main-scanning directions by a driving guide rod 231 and a driven guide rod 232 serving as guide members bridging between left-side and right-side plates 221A and 221B, and that is moved while scanning via a timing belt in arrow directions (carriage main-scanning directions) by a not-illustrated main-scanning motor.

The carriage 233 includes a recording head 234 integrally having liquid-jet heads having nozzles respectively ejecting ink drops of yellow (Y), cyan (0), magenta (M), and black (K), and ink tanks containing ink to be supplied to the respective liquid-jet heads. In the recording head 234 integrally having the liquid-jet heads and the respective ink tanks, a nozzle array formed of the nozzles held by the recording head 234 is disposed in a sub-scanning directions orthogonal to the main-scanning direction, and ink ejecting directions of the nozzles are downward.

The recording head 234 includes first and second recording heads 234*a* and 234*b*. Each of the recording heads 234*a* and 234*b* has two nozzle arrays. One of the nozzle arrays of the first recording head 234*a* is configured to eject black (K) liquid drops, and the other nozzle array of the first recording head 234*a* is configured to eject cyan (C) liquid drops. One of the nozzle arrays of the second recording head 234*b* is configured to eject magenta (M) liquid drops, and the other nozzle array of the second recording head 234*b* is configured to eject yellow (Y) liquid drops. Note that in this example, the recording head 234 has a two-head configuration for ejecting four color liquid drops; however, the recording head may have a one-head configuration having four nozzle arrays for ejecting four color liquid drops per head.

The ink tank 235 (i.e., ink tanks 235*a* and 235*b*) of the recording head 234 is supplied with respective colors of ink from respective colors of ink cartridges 210 via respective colors of supply tubes 236.

The serial-type image forming apparatus further includes a semicircular (sheet-feeding) roll 243 and a separation pad 244 made of a material having a high friction coefficient and directed to face the sheet-feeding roller 243. The sheet-feeding roll 243 and the separation pad 244 are used as a sheet-feeding part for feeding sheets 242 accumulated on a sheet-accumulating part (platen) 241 of a sheet-feeding tray 202. The sheet-feeding part composed of the sheet-feeding roller 243 and the separation pad 244 is configured to feed one sheet 242 at a time from the sheet-accumulating part 241, and the separation pad 244 is biased toward the sheet-feeding roller 243 side.

The serial-type image forming apparatus further includes a guide member 245 for guiding the sheet 242, a counter roller 246, a transfer guide member 247, an edge-pressing roll 249, and a presser member 248 in order to transfer the sheet 242 fed from the sheet-feeding part to a lower side of the recording head 234. The serial-type image forming apparatus also includes a transfer belt 251 to electrostatically attract the sheet 242 to transfer the sheet 242 to a position facing the recording head 234.

The transfer belt 251 is formed of an endless belt that is looped over a transfer roller 252 and a tension roller 253 so as to rotationally travel in a belt transferring direction (i.e., a sub-scanning direction). Further, the serial-type image forming apparatus further includes a charging roller 256 serving as a charging part configured to electrically charge a surface of the transfer belt 251. The charging roller 256 is disposed such that the charging roller 256 is brought into contact with a surface layer of the transfer belt 251 to be rotationally driven by the rotation of the transfer belt 251. The transfer belt 251 circumferentially travels in the belt transferring direction driven by the transfer roller 252 that is rotationally driven by a not-illustrated sub-scanning motor via the timing belt.

The serial-type image forming apparatus further includes a sheet-discharging part. The sheet-discharging part includes a separation claw 261 for separating the sheet 242 from the transfer belt 251, a sheet-discharge roller 262, a sheet-discharge spur 263, and a sheet-discharge tray 203 disposed at a lower side of the sheet-discharge roller 262.

The serial-type image forming apparatus further includes a duplex-printing unit 271 detachably attached at the back of the main body of the serial-type image forming apparatus. The duplex-printing unit 271 captures the sheet 242 rotationally transferred in a reverse direction of the transfer belt 251, reverses the sheet 242, and then feeds the reversed sheet 42 between the counter roller 246 and the transfer belt 251. The serial-type image forming apparatus further includes a manual bypass tray 272 on top of the duplex-printing unit 271

The serial-type image forming apparatus further includes a maintenance-restoration mechanism 281 serving as a head maintenance-restoration device including a restoration unit for maintaining and restoring the nozzle states of the recording head 234 in a non-printing region at one side of the carriage 233 in the carriage main-scanning direction. The maintenance-restoration mechanism 281 includes cap members 282*a* to 282*b* (hereinafter called "caps 282*a* to 282*b*" or simply called a "cap 282" as a generic name for the cap members 282*a* to 282*b*) for capping the respective nozzle faces of the liquid-jet recording head 234, a wiper blade 283 serving as a wiper blade member for wiping the nozzle faces and a discharged non-printing ink receiver 284 for receiving non-printing ink discharged from the liquid-jet head 284 when the thickened recording liquid is discharged as non-printing ink, due to its failure to function as the recording liquid.

The serial-type image forming apparatus further includes a non-printing ink receiver 288 in a non-printing region at the other side of the carriage 233 in the carriage main-scanning direction so as to receive the non-printing ink when the recording liquid is thickened and the thickened recording liquid is thus discharged. The non-printing ink receiver 288 includes an opening 289 along the nozzle array direction of the recording head 234.

In the image forming apparatus having the above configuration, the top sheet 242 is separated from the others in the sheet-feeding tray 202, the sheet 242 is approximately vertically disposed to be guided by the guide member 245, the sheet 242 is sandwiched between the transfer belt 251 and the counter roller 246 to be transferred, the edge of the sheet 242 is guided by the transfer guide member 297, and pressed against the transfer belt 251 by the edge-pressing roll 249, and by then the transfer direction of the sheet 242 is changed by approximately 90 degrees.

In this state, voltages are alternately applied to the charging roller 256 to repeatedly output positive and negative charges, such that the transfer belt 251 is charged with alternate charge voltage patterns corresponding to the charging roller 256. That is, the transfer belt 251 is charged such that the transfer belt 251 includes alternately disposed positive and negative charged bands having predetermined widths in the sub-scanning direction (i.e., a circumferential traveling direction of the transfer belt 251). When the sheet 242 is fed onto the transfer belt 251 that is alternately charged with positive and negative charge voltage patterns, the sheet 242 is electrostatically attracted by the transfer belt 251. The sheet 292 attracted to the transfer belt 251 is then transferred in the sub-scanning direction by circumferential traveling of the transfer belt 251.

The recording head 234 is driven based on image signals while the carriage 233 is moved such that the recording head 234 ejects ink drops onto the stationary sheet 242, thereby recording one line with the ejected ink drops. The sheet 242 is then transferred by a predetermined amount, and a next line is subsequently recorded on the sheet 242 with next ejected ink drops. The recording operation is terminated when a signal indicates that a rear end of the sheet 242 has reached a recording region. The sheet 242 is discharged onto the sheet-discharge tray 203.

Since the serial-type image forming apparatus includes the liquid-jet recording head according to the embodiments as the recording head, high-definition images may be stably formed.

Note that in the present application, a material of the "sheet" is not limited to paper, but may be an overhead projector (OHP) film, cloth, glass, and a substrate, to which ink drops or other liquids are attachable. Examples of such materials for the sheet may be called a "recording medium subject to being recorded on", a "recording medium", "recording paper", and a "recording sheet". Further, the terms "image forming", "recording", "printing", and "copying" may be used as synonyms.

In addition, the term an "image forming apparatus" indicates an apparatus that forms an image onto media such as paper, string, fiber, fabric, leather, metal, plastic, glass, wood, and ceramics by discharging liquid onto such media. Moreover, the term "forming an image" or "image formation" not only indicates providing an image having some kind of mean onto the media such as characters and symbols, but also indicates an image without having any meaning such as patterns (i.e., by simply discharging ink drops onto the media).

Further, the term "k" is not specifically limited to those generally called "ink", but may include a generically called "liquid" capable of forming an image, such as a recording liquid, a fixing liquid, and a liquid. The term "ink" may further include DNA specimens, resist, a patterning material, resin, and the like.

Moreover, the "image" is not limited to a two-dimensional image, but may include an image applied to a three-dimensionally formed object, or an image applied to a three-dimensional image formed of a molded object.

Further, the term "image forming apparatus" may include both a "serial-type image forming apparatus" and a "line-type image forming apparatus" unless otherwise specified.

According to the disclosed embodiments, the stress concentration applied to the boundary part between the thick part and the thin part of the diaphragm in the liquid-drop head may be reduced at low cost.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiment of the present invention has been described in detail, it should be understood that various changes, substitutions, and alterations could be made hereto without departing from the spirit and scope of the invention.

This patent application is based on Japanese Priority Patent Application No. 2012-061674 filed on Mar. 19, 2012, the entire contents of which are hereby incorporated herein by reference.

What is claimed is:

1. A liquid-jet head comprising:

a thin film member having a thin part and a thick part, at least a part of the thin film member being formed of an electroformed film, wherein the thin film member includes a metallic film forming the thin part, a first electroformed film formed on the metallic film, the first electroformed film forming the thick part, and a second electroformed film formed on a top surface of the first electroformed film and on the thin part, wherein the second electro formed film coats a lateral face of the thick part and coats a surface of the thin part, and the second electroformed film is continuously formed between the lateral face of the thick part and the surface of the thin part, to coat an intersection between the surface of the thin part and the lateral face of the thick part, the lateral face extending along a thickness direction of the thick part of the thin film member, and wherein each of the lateral face of the thick part and the surface of the thin part is interposed between the second electroformed film and the first electroformed film.

2. The liquid-jet head as claimed in claim 1, wherein the thin film member serves as a diaphragm member forming at least one wall surface of a liquid chamber that is in communication with nozzles configured to eject liquid drops.

3. The liquid-jet head as claimed in claim 2, wherein the thin part includes a filter part having a plurality of pores, the filter part being configured to filter a liquid.

4. The liquid-jet head as claimed in claim 1, wherein the thin film member forms a filter member configured to filter a liquid.

5. The liquid-jet head as claimed in claim 1, wherein a part of the second electroformed film covering a connecting part between the metallic film and the first electroformed film forms an R shape.

6. An image forming apparatus comprising the liquid-jet head as claimed in claim 1.

7. A liquid-jet head comprising:

a thin film member having a thin part and a thick part, at least a part of the thin film member being formed of an electroformed film, wherein the thin film member includes a first electroformed film forming the thick part, and a second electroformed film formed on a top surface of the first electroformed film wherein a portion of the second electroformed film coats a lateral face of the thick part, the lateral face extending along a thickness direction of the first electroformed film of the thin film member, wherein the thin part includes the second electroformed film continuously formed from the portion of the second electroformed film coating the lateral face of the thick part, and wherein the lateral face of the thick part is interposed between the second electroformed film and the first electroformed film.

8. The liquid-jet head as claimed in claim 7, wherein the first electroformed film and the second electroformed film are made of electroformed films differing from each other.

9. The liquid-jet head as claimed in claim 8, wherein the first electroformed film is made of a material having a high Young's modulus, and the second electroformed film is made of a material having a low Young's modulus.

10. The liquid-jet head as claimed in claim 7, wherein the first electroformed film and the second electroformed film are made of electroformed films having mean particle sizes differing from each other.

11. The liquid-jet head as claimed in claim 7, wherein the thin film member serves as a diaphragm member forming at least one wall surface of a liquid chamber that is in communication with nozzles configured to eject liquid drops.

12. The liquid-jet head as claimed in claim 11, wherein the thin part includes a filter part having a plurality of pores, the filter part being configured to filter a liquid.

13. The liquid-jet head as claimed in claim 7, wherein the thin film member forms a filter member configured to filter a liquid.

14. The liquid-jet head as claimed in claim 7, wherein the thick part of the thin film member includes a connecting part between the thick part and the thin part, and a part of the second electroformed film covering the connecting part forms an R shape.

15. An image forming apparatus comprising the liquid-jet head as claimed in claim 7.

16. The liquid-jet head as claimed in claim 7, further comprising:

a piezoelectric member disposed on a connecting part of the thick part of the thin film member, wherein the second electroformed film covers the connecting part between the piezoelectric member and the first electroformed film.

* * * * *